US006878055B2

(12) United States Patent
Lafleur

(10) Patent No.: US 6,878,055 B2
(45) Date of Patent: Apr. 12, 2005

(54) WINDOW ASSEMBLY

(76) Inventor: Jean-Claude Lafleur, 306 rue Dubé, Thetford Mines, Quebec (CA), G6G 3B7

( * ) Notice: Subject to any disclaimer, the term of this patent is extended or adjusted under 35 U.S.C. 154(b) by 0 days.

(21) Appl. No.: 10/794,603

(22) Filed: Mar. 5, 2004

(65) Prior Publication Data

US 2004/0188040 A1 Sep. 30, 2004

(30) Foreign Application Priority Data

Mar. 5, 2003 (CA) ..... 2421253

(51) Int. Cl.[7] ..... E06B 7/02

(52) U.S. Cl. ..... 454/196; 454/212; 454/213; 454/219; 454/222

(58) Field of Search ..... 454/196, 212, 454/213, 219, 222

(56) References Cited

U.S. PATENT DOCUMENTS 821,101 A * 5/1906 Hyde ..... 454/222
1,790,733 A 2/1931 Tracy
1,952,018 A * 3/1934 Madsen ..... 49/67
2,725,935 A * 12/1955 Seidel ..... 160/91
4,295,417 A * 10/1981 Isley ..... 454/213

FOREIGN PATENT DOCUMENTS

CA 2202205 6/2001

* cited by examiner

*Primary Examiner*—Harold Joyce
(74) *Attorney, Agent, or Firm*—Collard & Roe P.C.

(57) ABSTRACT

A window assembly (1) enabling an innovative manner of adjustably allowing an air circulation between an outside environment of the window assembly (1) and an inside environment of the window assembly (1), the inside environment not being affected by wind and/or precipitation conditions in the outside environment as a result of said circulation. The window assembly (1) comprises a bottom section (15) and at least one intermediate section (17) placed above the bottom section (15) and operatively connected thereto, an air circulation being carried out between a front side **(11*a*) of the bottom section (15) and a rear side (13*b*) of the intermediate section (17) in an indirect manner via a bottom side (19) of the intermediate section (17). Regular means (21) are also provided for regulating the passage of air through said bottom side (19). The window assembly (1) is further devised so that the different components thereof may be advantageously manufactured, assembled, installed, serviced and/or replaced, as well as adjustably positioned so as to enable different window configurations, while ensuring an insulatedly sound window assembly 1**.

18 Claims, 8 Drawing Sheets

(SECTION A-A)

(SECTION B-B)

(SECTION A-A)

WINDOW ASSEMBLY

FIELD OF THE INVENTION

The present invention relates to the field of windows, as well as to the field of manufacturing, assembling, installing, servicing, and/or replacing the same. More particularly, the present invention relates to a window assembly enabling an innovative manner of adjustably allowing an air circulation between an outside environment of the window assembly and an inside environment of the window assembly, the inside environment not being affected by wind and/or precipitation conditions in the outside environment as a result of said air circulation. The window assembly is further devised so that the different components thereof may be advantageously manufactured, assembled, installed, serviced, and/or replaced, as well as adjustably positioned so as to enable different window configurations, while ensuring an insulatedly sound window assembly. The present invention also relates to a building provided with the present window assembly.

BACKGROUND OF THE INVENTION

Window frames and assemblies have existed for many years now and are thus very well known in the art. Indeed, an air circulation between an outside environment of a typical window assembly (i.e. outdoors) and an inside environment of the window assembly (i.e. indoors) is generally carried out by displacing a glass panel, or simply "window", of the assembly, with respect to its frame. Indeed, most window assemblies either comprise at least one glass panel which is slidably moveable vertically or horizontally with respect to the window frame, or either one that is pivotally moveable inwardly, but most often outwardly, with respect to the window frame, so that when the glass panel is displaced in an open configuration, a direct passage between the outside environment and the inside environment is defined through an opening left behind by the displacement of the glass panel (i.e. window). Said opening within the frame may be provided with a corresponding fly screen as is well known in the art. Traditionally, fly screens were placed outside of the window assemblies, but most recently, most window assemblies comprise fly screens which are provided within the window frame.

Also known in the art are the various disadvantages associated with the above-described types of conventional window assemblies. Indeed, because a direct passage is defined between the outside environment and the inside environment when the window or glass panel is left in an open configuration, the inside environment (i.e. the inside of the room of the window assembly) is therefore directly subject to the weather conditions of the outside environment. This means that when a conventional window assembly is left unattended, for example, with adverse weather conditions being present outside, gusts of winds and/or precipitation (rain, snow, and the like) may directly enter into the inside of the room, which is very disadvantageous for obvious reasons known in the art.

Another substantial disadvantage associated with conventional window assemblies is that the glass panels which are pivotally moveable with respect to the window frame are generally operated by means of corresponding hardware, such as four-bar mechanisms, hinges, rotating levers, and the like, which are often difficult to operate, requiring some physical effort and/or being substantially time-consuming. Moreover, this type of hardware is subject to breakdown after a certain period of time, and servicing and/or replacement thereof is generally very costly, which is also very disadvantageous for obvious reasons known in the art.

Another substantial disadvantage associated with conventional window assemblies is that they are not devised to have components which may be easily mountable and demountable, so as to be advantageously manufactured, assembled, installed, serviced, and/or replaced. Indeed, very often, when a given component of a conventional window assembly is faulty or defective, several other corresponding components of the assembly must be removed, and this is generally very tedious and time consuming because the construction of conventional window assemblies is fairly elaborate, cumbersome, and limiting, that is, does not offer modular capabilities and/or different window configurations. Furthermore, repairs and/or servicing to conventional window assemblies generally need to be carried out from the outside of the window assembly, which is also very disadvantageous, particularly when dealing with high establishments.

Another substantial problem associated with conventional window assemblies is that they generally comprise fly screens which are disposed within the frame which hinder the field of view onto the outside environment from the inside environment.

Yet another problem associated with conventional window assemblies is that their glass panels are generally subject to great heat losses from the inside environment to the outside environment when it is very cold outside, which is very disadvantageous for obvious reasons. Unfortunately, the designs of conventional window assemblies do not enable the glass panels to be optionally provided with additional insulating means so as to reduce these heat losses. The converse could also be said in regards to conserving cool air inside when it is very warm outside.

As may now be better appreciated, there are several drawbacks associated to the traditional way of circulating air within a given establishment with conventional window assemblies.

Therefore, it would be useful to provide a window assembly which enables a more precise regulation of air circulation within a given home at all times without having to endure the drawbacks inherent to the conventional way of opening window assemblies. Moreover, it would be very useful to provide a complementary air circulation capable of operating constantly and adjustably, and which could compensate for the failures and the drawbacks of ventilation systems which are dependent on electrical energy sources or others. Moreover, it would be also very useful to provide a window assembly offering a maximal security without it being apparent nor from the inside nor from the outside of the home. Furthermore, it would be very useful to provide a window assembly which may be opened without any substantial physical effort and which would not require the use of hardware, such as four-bar mechanisms, hinges, rotating levers, and the like. It would also be very useful to provide a window assembly having a fly screen which would not hinder the field of view onto the outside from the inside, and which would be conveniently displaceable and kept into place within the frame so as to allow an easy access to an outer surface of the glass panels in order to clean them, for example. Furthermore, it would be very useful to provide a window assembly having inclined glass panels which could be provided with additional insulating means for preserving the heat inside during cold temperatures, and for preserving cool air inside during very warm temperatures outside. It would be also very useful to provide a window assembly which could be left opened when it is raining, snowing, and the like, or when wind is blowing very hard, and this at all times, even when the occupants of the home are absent, and which would prevent the inside environment from being affected from these adverse weather conditions. It would be also very useful to provide an economical window assembly devised to have components and glass panels which can be easily assembled, installed, serviced, and/or replaced, and which enables different window configurations due to the modular aspect of the assembly, and this being able to be carried out from within a given home.

Hence, in light of the aforementioned, there is a need for an improved window assembly.

SUMMARY OF THE INVENTION

The object of the present invention is to provide a window assembly which, by virtue of its design and components, would be able to satisfy some of the above-mentioned needs and/or overcome some of the aforementioned prior art problems, and which is thus an improvement over other related window assemblies known in the prior art.

In accordance with the present invention, the above object is achieved, as will be easily understood, with a window assembly for adjustably allowing an air circulation between an outside environment of the window assembly and an inside environment of the window assembly, the window assembly comprising a rectangular frame having opposite top and bottom panels, and opposite left and right side panels, the frame having a front side for cooperating with the outside environment, and a rear side for cooperating with the inside environment, the window assembly comprising:

a bottom section within the frame, the bottom section having a front side extending along the front side of the frame and a rear side extending along the rear side of the frame, the front side of the bottom section having an opening for receiving air from the outside environment;

at least one intermediate section within the frame, and positioned above the bottom section, the at least one intermediate section having a front side extending along the front side of the frame and a rear side extending along the rear side of the frame, the rear side of the at least one intermediate section having an opening for receiving air from the opening on the front side of the bottom section via a bottom side of the at least one intermediate section; and regulating means cooperating with the bottom side of the at least one intermediate section and movable with respect to said bottom side for regulating the passage of air therethrough.

Preferably, the window assembly comprises a first front support plate mounted onto the front side of the frame, the first front support plate having ends connected respectively to the left and right side panels of the frame, and a first rear support plate mounted onto the rear side of the frame, the first rear support plate having ends connected respectively to the left and right side panels of the frame, said support plates delimiting the bottom section from the at least one intermediate section of the frame.

Preferably also, the window assembly comprises a second rear support plate mounted onto the rear side of the frame, above the first rear support plate, the second rear support plate also having ends connected respectively to the left and right side panels of the frame, the first front support plate and the second rear support plate being provided with profiled connectors, and wherein the at least one intermediate section comprises a glass panel extending in a slanted manner within the at least one intermediate section of the frame from the front side to the rear side thereof, the glass panel having a bottom peripheral edge operatively connected to the profiled connector provided on the first front support plate and a top peripheral edge operatively connected to the profiled connector provided on the second rear support plate.

Preferably also, the bottom and top peripheral edges of the glass panel are provided with profiled connectors having portions being complementary in shape to portions of the profiled connectors provided on the support plates.

According to another aspect of the invention, there is also a building provided with a window assembly such as the one briefly described herein and such as the one exemplified in the accompanying drawings.

The objects, advantages and other features of the present invention will become more apparent upon reading of the following non-restrictive description of preferred embodiments thereof, given for the purpose of exemplification only with reference to the accompanying drawings.

DETAILED DESCRIPTION OF PREFERRED EMBODIMENTS OF THE INVENTION

Figure 1:
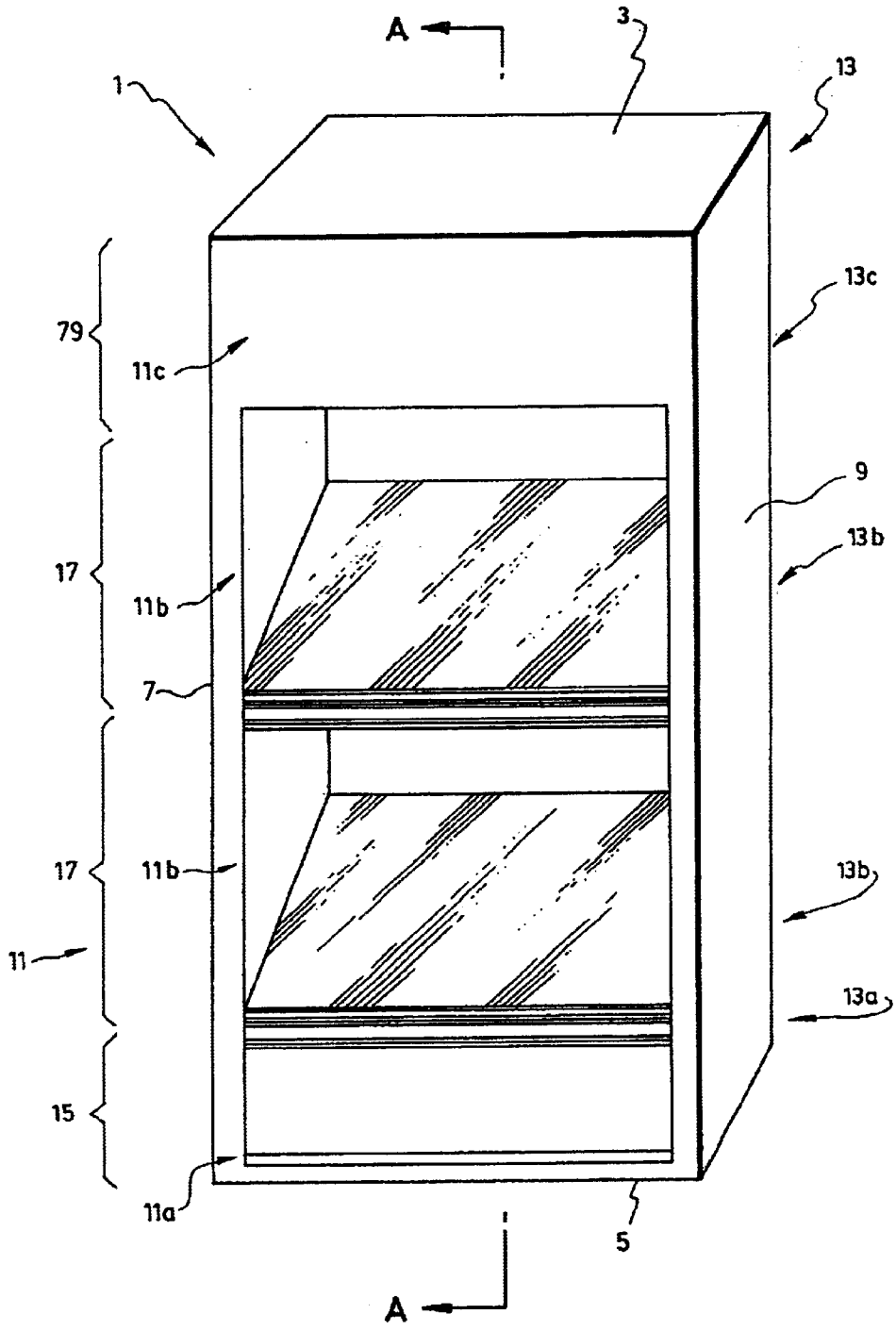
FIG. 1 is a front perspective view of a window assembly according to a preferred embodiment of the present invention, the window assembly being shown comprising a bottom section, a pair of first and second intermediate sections, and a top section.

In the following description, the same numerical references refer to similar elements. The embodiments shown in the figures are preferred.

Moreover, although the present invention was primarily designed for use with a wall structure of a room of an establishment, such as a house, a building, and the like, it may be used with other types of structures and objects, such as motor homes for example and the like, and in other fields, as apparent to a person skilled in the art. For this reason, expressions such as "room", "house", "building", "home", etc., and any equivalent expression and/or compound word thereof used herein should not be taken as to limit the scope of the present invention and includes all other kinds of objects or fields with which the present invention could be used and may be useful.

Moreover, in the context of the present invention, the expressions "window", "assembly", "device", "frame", and any other equivalent expression and/or compound words thereof known in the art will be used interchangeably. Furthermore, the same applies for any other mutually equivalent expressions, such as "outside environment" and "outdoors", or "inside environment" and "indoors", as well as "window" and "glass panel", or even "bottom and intermediate sections" and "intermediate and top sections", for example, as also apparent to a person skilled in the art.

In addition, although the preferred embodiment of the present invention as illustrated in the accompanying drawings may comprise various components, and although the preferred embodiment of the window assembly 1 as shown consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the window assembly 1 and corresponding parts according to the present invention, as will be briefly explained hereinafter and as can be easily inferred herefrom, without departing from the scope of the invention.

Broadly described, the present invention, as illustrated in the accompanying drawings, relates to a window assembly 1 to be mounted onto a wall structure of a given room and devised for allowing the passage of air (and preferably light through a corresponding glass panel 33) between an environment outside the room (i.e. outdoors) and an environment inside the room (i.e. indoors), as is the case with most windows. More particularly, the present invention relates to a window assembly 1 enabling an innovative manner of adjustably allowing an air circulation between an outside environment of the window assembly 1 and an inside environment of the window assembly 1, the inside environment not being substantially affected by wind and/or precipitation conditions in the outside environment as a result of said air circulation. The window assembly 1 is further devised so that the different components thereof may be easily mountable and demountable so as to be advantageously manufactured, assembled, installed, serviced, and/or replaced, while ensuring an insulatedly sound window assembly, and enabling different window configurations (namely, the possibility of having a plurality of intermediate sections 17, and the possibility of positioning and adjusting support plates 23, 25, 27 along the frame of the window assembly 1 so as to enable said window assembly 1 to have different glass panel lengths and/or inclinations). The present invention also relates to a building provided with the present window assembly 1. As will be briefly shown and explained hereinbelow, the present window assembly 1 possesses several other advantages when compared to conventional windows known in the art.

As better shown in FIG. 1, the window assembly 1 comprises a rectangular frame having opposite top and bottom panels 3,5, and opposite left and right side panels 7,9, the frame having a front side 11 cooperating with the environment outside of the room, and a rear side 13 cooperating with the environment inside the room. It is worth mentioning that according to the present invention, the frame of the window assembly 1 need not to be rectangular, as can be easily understood, so long as it consists of a suitable frame for receiving and supporting the different components of the window assembly 1, as will be explained hereinbelow, and as also apparent to a person skilled in the art. As is also well known in the art, the top panel 3 of the window assembly 1 is generally referred to as "lintel", the bottom panel 5 of the window assembly 1 is generally referred to as "sill", and the left and right side panels 7, 9 are generally referred to as "jambs".

As also better shown in FIG. 1, the window assembly 1 according to this particular embodiment comprises a bottom section 15, a pair of first and second intermediate sections 17 above the bottom section 15, and a top section 79 above the former sections 17. It is worth mentioning that according to the present invention, the window assembly 1 may comprise a single and/or a plurality of intermediate sections 17, and that the top section 79 is not absolutely necessary for proper operation of the window assembly 1 according to its innovative features, as described herein. Indeed, in order to ensure a minimal operation of the window assembly 1, it only requires one bottom section 15 and one intermediate section 17, as will be easily understood when reading the following description.

Figure 2B:
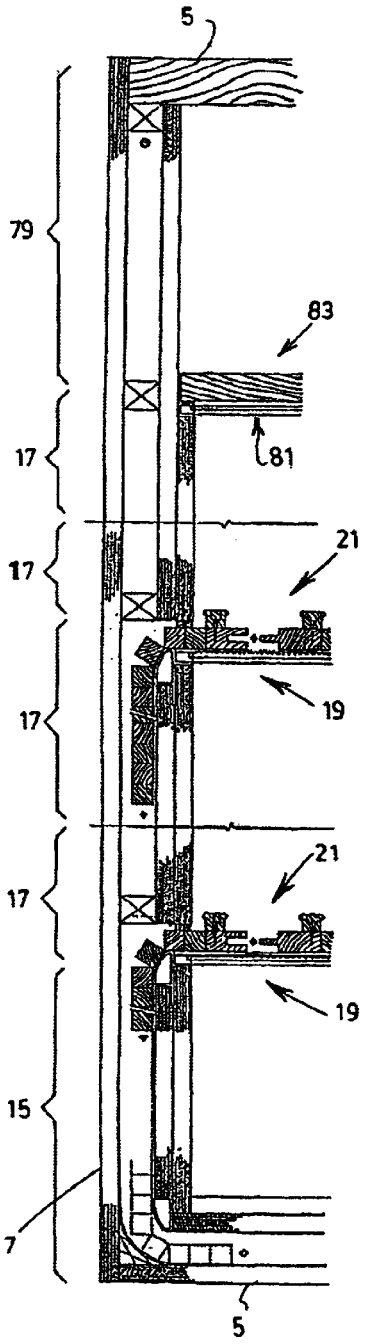
FIG. 2*b* is a fragmentary sectional view taken along section B—B of the window assembly shown in FIG. 2*a*.
Figure 2A:
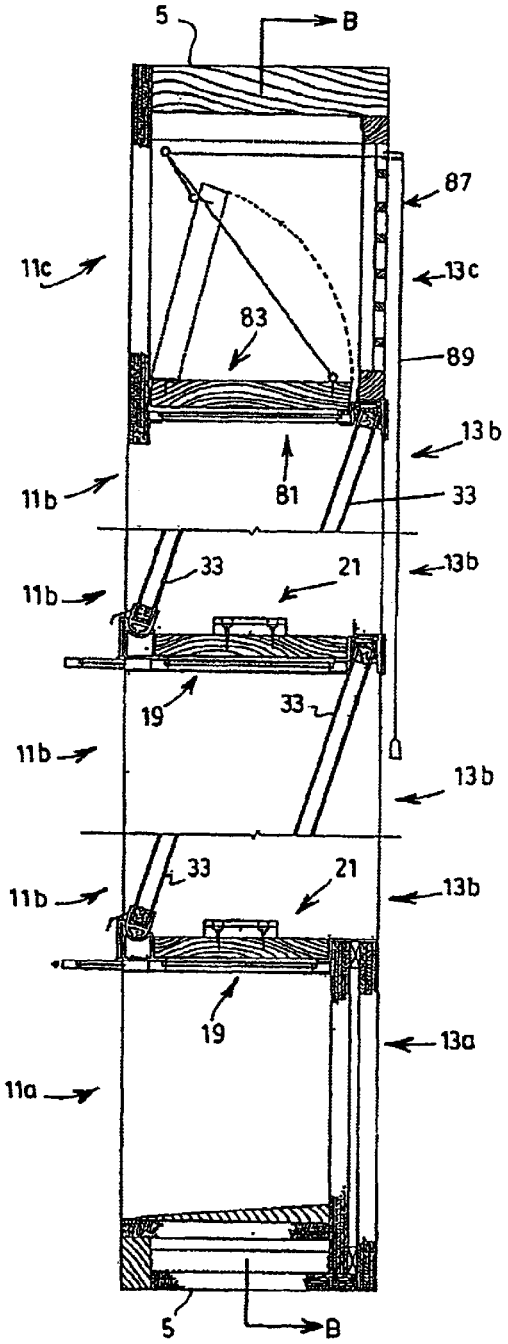
FIG. 2*a* is a fragmentary sectional view taken along section A—A of the window assembly shown in FIG. 1.

Indeed, as aforementioned, and as better illustrated in FIGS. 1 and 2, the window assembly 1 according to the present invention comprises a bottom section 15 within the frame, the bottom section 15 having a front side 11*a* extending along the front side 11 of the frame and a rear side 13*a* extending along the rear side 13 of the frame, the front side 11*a* of the bottom section 15 having an opening for receiving air from the outside environment. The rear side 13*a* of the bottom section 15 may be covered by suitable means (not shown), such as drywall and the like, as apparent to a person skilled in the art.

The window assembly 1 also comprises at least one intermediate section 17 within the frame, and positioned above the bottom section 15, the at least one intermediate section 17 having a front side 11*b* extending along the front side 11 of the frame and a rear side 13*b* extending along the rear side 13 of the frame, the rear side 13*b* of the at least one intermediate section 17 having an opening for receiving air from the opening on the front side 11*a* of the bottom section 15 via a bottom side 19 of the at least one intermediate section 17, and so as to allow an air circulation in an indirect manner between the front side (i.e. outdoors) and the rear side (i.e. indoors) of the frame. Indeed, the rear side 13*b* of the at least one intermediate section 17 cooperates with the inside of the room.

It is worth mentioning that according to the present invention, the front and rear sides 11*a*, 13*a*, 11*b*, 13*b* of the bottom section 15 and at least one intermediate section 17 need not be coplanar with each other or with the front and rear sides 11, 13 of the frame of the window assembly 1, as apparent to a person skilled in the art.

As better shown in FIGS. 2–6, the window assembly 1 comprises regulating means 21 cooperating with the bottom side 19 of the at least one intermediate section 17 and movable with respect to said bottom side 19 for regulating the passage of air therethrough, and thus regulating the passage of air between the outside of the window assembly 1 and the inside of the window assembly 1.

Thus, as can now better be appreciated, and when referring to FIGS. 2–6, the window assembly 1 according to the present invention is devised so as to enable an air passage from the front side 11 of the frame to the rear side 13 thereof, in an indirect manner, that is, by traveling into the bottom section 15 via the front side 11*a* thereof, then through the bottom side 19 of the at least one intermediate section 17, and finally ending up into the inside environment through the rear side 13*b* of the at least one intermediate section 17. As can be easily understood, in FIGS. 5 and 6, the first intermediate section 17 acts as a "bottom section" 15 for the second intermediate section 17 placed above it. It is worth mentioning also that this direction of travel of the air may also be inverted, that is, from the inside environment to the outside environment, depending on the temperature gradients between the outside environment and the inside environment, as apparent to a person skilled in the art.

Thus, as a result of the above-mentioned construction, the present window assembly 1 enables an innovative manner of adjustably allowing an air circulation between an outside environment of the window assembly 1 and an inside environment of the window assembly 1, the inside environment not being affected by wind and/or precipitation conditions in the outside environment as a result of said air circulation, because said air circulation is carried out between the outside environment and the inside environment in an indirect manner, as described above, the bottom and intermediate sections 15, 17 being shaped and sized accordingly, as can be easily understood by a person skilled in the art.

As can also be easily understood from FIG. 1, and as better shown in FIGS. 3–6, the window assembly 1 according to the present invention comprises a first front support plate 23 mounted onto the front side 11 of the frame, the first front support plate 23 having ends connected respectively to the left and right side panels 7, 9 of the frame, and a first rear support plate 25 mounted onto the rear side 13 of the frame, the first rear support plate 25 also having ends connected respectively to the left and right side panels 7, 9 of the frame, said support plates 23, 25 delimiting the bottom section 15 from the at least one intermediate section 17 of the frame, and as can be easily understood, or, as previously mentioned, delimiting the "first intermediate section" 17 from the "second intermediate section" 17 placed above it, or as will be explained in greater detail hereinbelow, delimiting an intermediate section 17 from a top section 79 placed above it.

The window assembly 1 also preferably comprises a second rear support plate 27 mounted onto the rear side 13 of the frame, above the first rear support plate 25, the second rear support plate 27 also having ends connected respectively to the left and right side panels 7, 9 of the frame. The ends of the support plates 23, 25, 27 of the window assembly 1 according to the present invention, and more particularly the ends of the front support plates 23, may be provided with suitable components, so as to prevent tampering thereof, and thus ensure a maximal security of the window assembly 1 against theft and the like, as apparent to a person skilled in the art.

Figure 3:
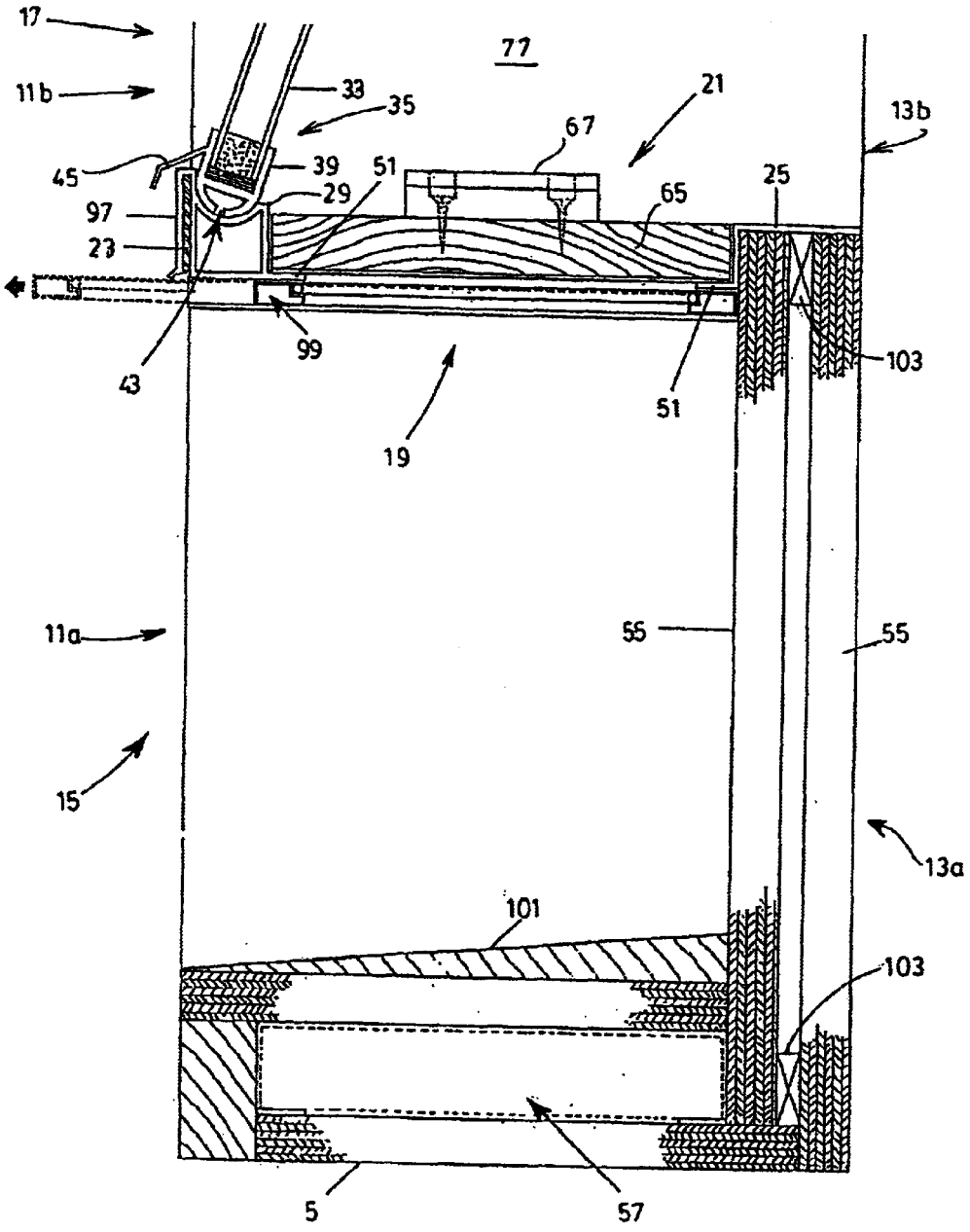
FIG. 3 is an enlarged view of the bottom section and a partial view of the first intermediate section of the window assembly shown in FIG. 2*a*.
Figure 5:
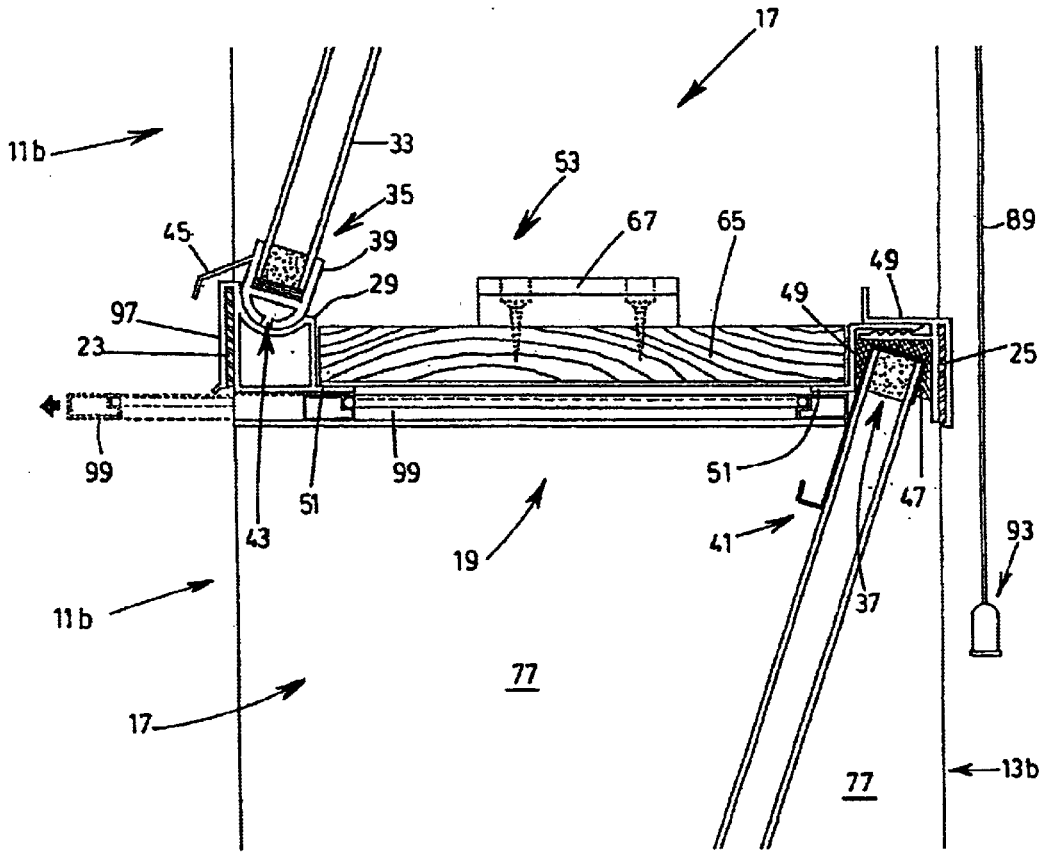
FIG. 5 is a partial view of the first and second intermediate sections of the window assembly shown in FIG. 2*a*.
Figure 7:
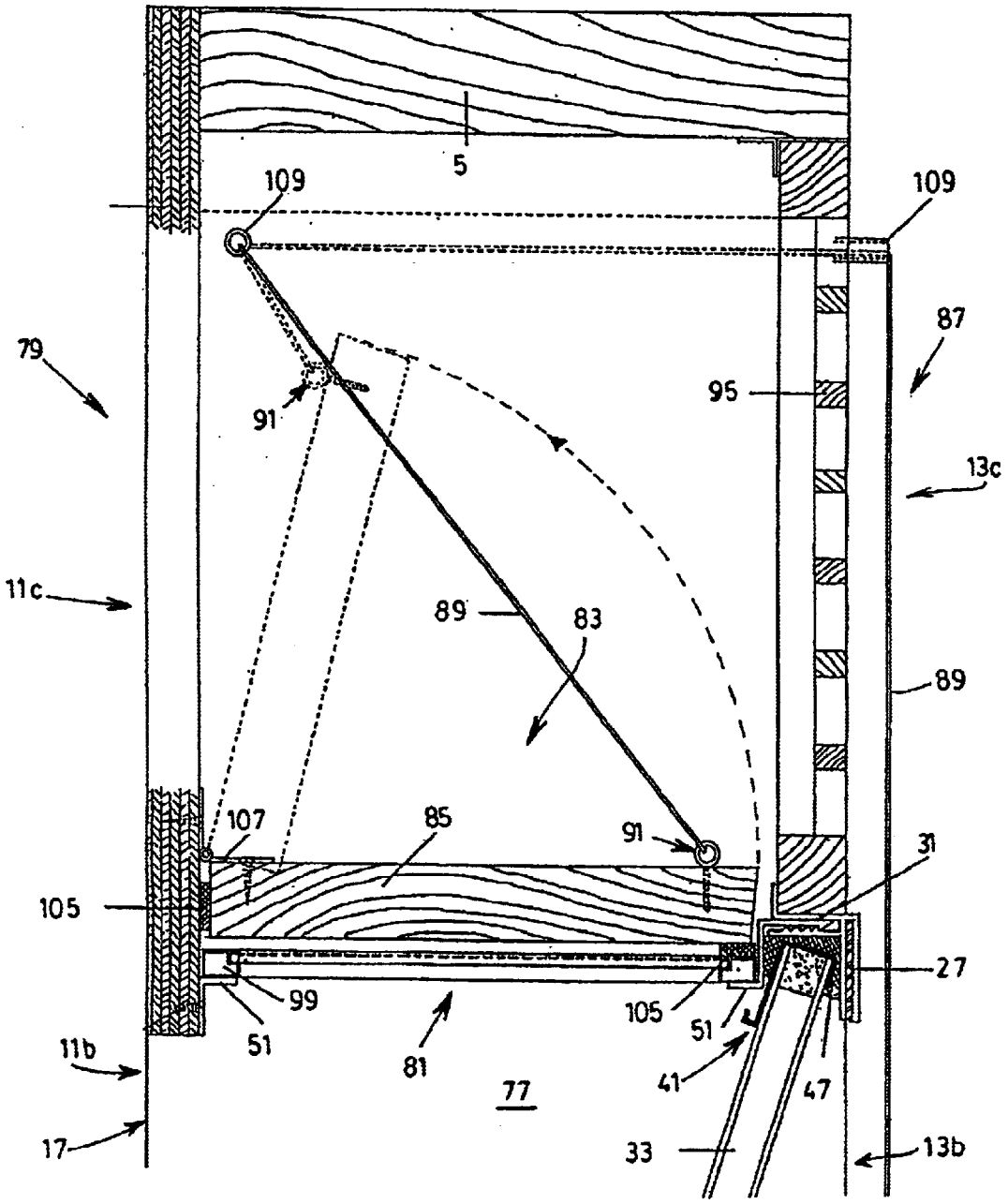
FIG. 7 is a partial view of the second intermediate section and an enlarged view of the top section of the window assembly shown in FIG. 2*a*.
Figure 8:
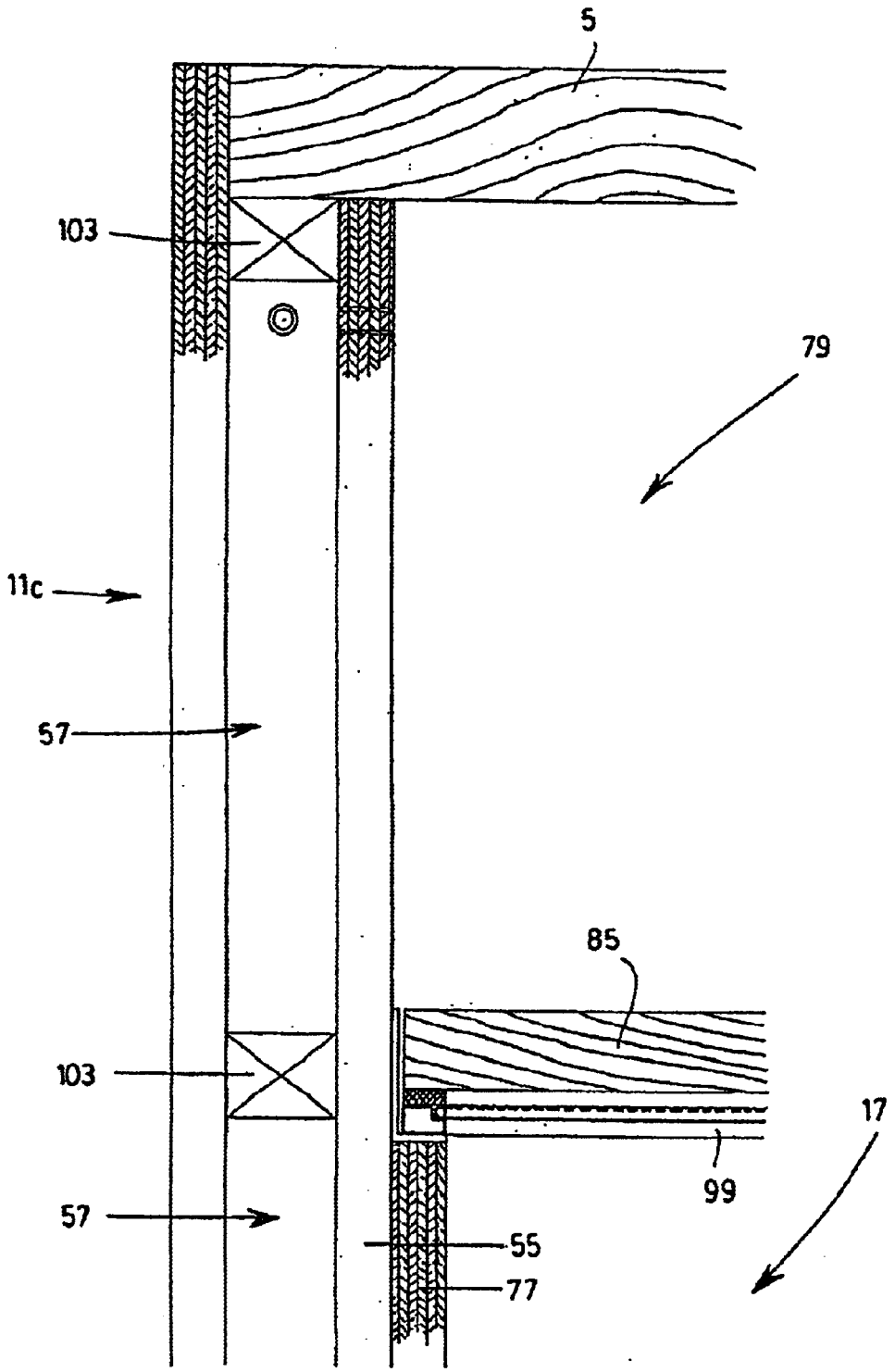
FIG. 8 is a partial view of the second intermediate section and an enlarged view of the top section of the window assembly shown in FIG. 2*b*.

In order to assemble a given intermediate section of the window assembly 1, the first front support plate 23 and the second rear support plate 27 are preferably provided with profiled connectors 29, 31, and the at least one intermediate section 17 comprises a glass panel 33 extending in a slanted manner within the at least one intermediate section 17 of the frame from the front side 11 to the rear side 13 thereof, the glass panel 33 having a bottom peripheral edge 35 operatively connectable to the profiled connector 29 provided on the first front support plate 23 and a top peripheral edge 37 operatively connectable to the profiled connector 31 provided on the second rear support plate 27, as can be easily understood from FIGS. 3, 5 and 7. Preferably also, the profiled connector 31 provided on the second rear support plate 27 preferably consists of a two-part component having a first part mounted onto the second rear support plate 27 with first and second lips shaped and sized to receive a corresponding flange of the second component of the profiled connector 31, a corresponding lip of the first component of the profiled connector 31 being segmented and cooperating with a corresponding hook of the corresponding flange of the second component of the profiled connector 31, as can be easily understood and as better shown in FIGS. 5 and 7. Thus, it may now be better appreciated on how the present window assembly 1 by virtue of its components, namely the support plates 23, 25, 27 (and corresponding connectors), enable the same to be selectively adjusted and positioned along the frame so as to have a window assembly 1 capable of having different glass panel lengths and/or inclinations, depending on where the support plates 23, 25, 27 are placed along the frame, as can be easily understood by a person skilled in the art.

Preferably, as also shown, the bottom and top peripheral edges 35, 37 of the glass panel 33 are provided with profiled connectors 39, 41 having portions being complementary in shape to portions of the profiled connectors 29, 31 provided on the support plates 23, 27. As better shown in FIGS. 3 and 5, the profiled connector 29 provided on the first front support plate 23 preferably comprises a concave portion for receiving preferably a convex portion of the corresponding profiled connector 39 provided on the bottom peripheral edge 35 of the glass panel 33. Preferably, the profiled connector 39 provided on the bottom peripheral edge 35 of the glass panel 33 comprises a slit 43, which is preferably defined by first and second lips of the profiled connector 39, as also better shown in FIGS. 3 and 5. This slit 43 is particularly useful for receiving an excess of sealant, such as caulking for example, which may be provided between the profiled connectors 29, 39 so as to ensure an insulatedly sound window assembly 1. As will be better described and as will be easily inferred from the following description, adjacent components of the window assembly 1 are preferably provided with suitable sealing means 105 so as to ensure a proper insulation of the window assembly 1, as apparent to a person skilled in the art.

Furthermore, the profiled connector 39 provided on the bottom peripheral edge 35 of the glass panel 3 preferably comprises an evacuating flange 45 extending outwardly from the front side 11 of the frame, beyond the profiled connector 29 provided on the first front support plate 23. As can be easily understood, any precipitation from the outside environment hitting against an outer or "front" surface of the glass panel 33 will trickle down the same and be rejected outwardly from the front side 11 of said frame via the evacuating flange 45.

It is worth mentioning that according to the present invention, the evacuating flange 45 is made integral to the profiled connector 39 provided on the bottom peripheral edge 35 of the glass panel 33 for facilitating assembling steps, etc., as can be easily understood, but alternatively, a similar evacuating flange 45 may be provided onto another suitable corresponding component of the window assembly 1, such as on a bottom portion of the glass panel 33 for example, for carrying out similar purposes, as apparent to a person skilled in the art.

Preferably, as better shown in FIG. 7, the window assembly 1 comprises a weather strip 47 placed between the top peripheral edge 37 of the glass panel 33 and the profiled connector 31 provided on the second rear support plate 27. This confirms what has already been previously discussed in that the different components of the window assembly 1 may be provided with suitable sealing means 105, which are well known, as apparent to a person skilled in the art. However, it is worth mentioning that although these sealing means 105 are preferred for obvious reasons, they are not considered to be essential for the window assembly 1 to carry out its corresponding functions, as described herein and can be easily understood herefrom.

Preferably, as better shown in FIG. 5, the first rear support plate 25 is also provided with a profiled connector 49, the profiled connectors 29, 49 provided on the first front support plate 23 and the first rear support plate 25 each having a support flange 51 for supporting the regulating means 21. As can be easily understood from FIGS. 5 and 7, the second rear support plate 27 of a given intermediate section 17 may simply correspond to the first rear support plate 25 of an upper adjacent intermediate section 17, and thus the expressions "first rear support plate" 25 and "second rear support plate" 27 may be used interchangeably in the context of the present description, when appropriate, as apparent to a person skilled in the art.

Preferably, as better shown in FIGS. 2–8, the regulating means 21 preferably comprise at least one shutter 53 slidably movable along the support flanges 51 of the connectors 29, 49 provided on the first front support plate 23 and the first rear support plate 25, the at least one shutter 53 being operable between a closed configuration where the at least one shutter 53 covers the bottom side 19 of the least one intermediate section 17 and thus impedes air from passing therethrough, and an opened configuration where the at least one shutter 53 is urged away from the bottom side 19 so as to allow the passage of air from the opening on the front side 11*a* of the bottom section 15 to the opening on the rear side 13*b* of the at least one intermediate section 17 via said bottom side 19 of the at least one intermediate section 17. It is worth mentioning, as can be easily understood, that the regulating means 21 according to the present invention may consist of other suitable means 21, for properly "shutting" the bottom side 19 when the regulating means 21 are in a closed configuration, and for allowing the passage of air through said bottom side 19 when the regulating means 21 are in an opened configuration, as apparent to a person skilled in the art, but according to the preferred embodiment of the present invention, slidably moveable shutters have been used for their convenience in terms of assembling, operation, and the like.

Preferably, as also shown in FIGS. 2–8, the frame preferably comprises an additional side panel 55 positioned adjacent to a corresponding side panel 7, 9 for defining thereinbetween an empty space 57, said empty space 57 being shaped and sized for receiving a retracted portion of the at least one shutter 53 when operated in the opened configuration, through a corresponding slot 59 provided on the additional side panel 55. Preferably, the slot 59 is provided with a sealing brush 61, as better shown in FIGS. 4 and 6. It is worth mentioning that other suitable means may be used for providing an appropriate seal between the additional side panel 55 (or corresponding slot 59) and the shutter 53, and that these sealing means may be suitably located and mounted onto other corresponding components of the window assembly 1, as apparent to a person skilled in the art.

According to the preferred embodiment of the present invention as illustrated in the accompany drawings, the at least one shutter 53 preferably comprises left and right shutters 53*l*, 53*r* operable between a closed configuration where the shutters 53 are placed adjacent to each other so as to cover the bottom side 19 of the least one intermediate section 17 and thus impede air from passing therethrough, and an opened configuration where the shutters 53 are distanced from each other so as to expose the bottom side 19 of the at least one intermediate section 17 and allow the passage of air from the opening on the front side 11*a* of the bottom section 15 to the opening on the rear side 13*b* of the at least one intermediate section 17 via said bottom side 19 of the at least one intermediate section 17.

Preferably, as also shown, the frame comprises an additional left side panel 55*l* positioned adjacent to the left side panel 7 for defining thereinbetween a left empty space 57*l*, said left empty space 57*l* being shaped and sized for receiving a retracted portion of the left shutter 53*l* when operated in the opened configuration, through a corresponding slot 59 provided on the additional left side panel 55*l*, and wherein the frame comprises an additional right side panel 55*r* positioned adjacent to the right side panel 9 for defining thereinbetween a right empty space 57*r*, said right empty space 57*r* being shaped and sized for receiving a retracted portion of the right shutter 53*r* when operated in the opened configuration, through a corresponding slot 59 provided on the additional right side panel 55*r*. Preferably also, as can be easily understood from FIGS. 4 and 6, the slots 59 of the additional left and right side panels 55 are provided with corresponding sealing brushes 61.

Preferably, as better shown in FIGS. 3–6, each shutter 53 comprises a substantially rectangular malleable curtain 63, said curtain 63 being devised to slide along the support flanges 51 of the connectors 29, 49 provided on the first front support plate 23 and the first rear support plate 25. Preferably also, the curtain 63 is provided with a plurality of lamellae 65 extending transversally to the curtain 63. These lamellae 65 are preferably intended to provide an additional insulation to the regulating means 21 when in the closed configuration so as to additionally prevent the passage of air and/or heat between the bottom section 15 and the at least one intermediate section 17. It is worth mentioning though, as apparent to a person skilled in the art, that other suitable additional insulation means may be provided on the curtain 63 of the regulating means 21. Moreover, it is also worth mentioning that these additional insulation means and curtain 63 may be made integral to each other, that is made of a single piece and of a single material. Consequently, according to the present invention, the curtain 63 may be deprived of lamellae 65 and made to a given thickness so as to provide a suitable insulation to the bottom side 19 of the at least one intermediate section 17, when the regulating means 21 are in a closed configuration, as also apparent to a person skilled in the art.

Preferably, as better shown in FIGS. 3–6, each shutter 53 preferably comprises a handle 67 for facilitating manual operation of the shutters 53 between opened and closed configurations. As also shown, an end portion 69 of the right shutter 53*r* preferably comprises a male component removably insertable into a female component of an end portion 71 of the left shutter 53*l*, and the male and female components are preferably securely affixed to each other by means of a pin being removably insertable into corresponding bores of the components. It is worth mentioning also that, according to the present invention, other suitable means may be used for ensuring a proper seal between the left and right shutters 53*l*, 53*r*, and other suitable means may also be used for maintaining the shutters 53 securely affixed to one another when in the closed configuration.

Figure 4:
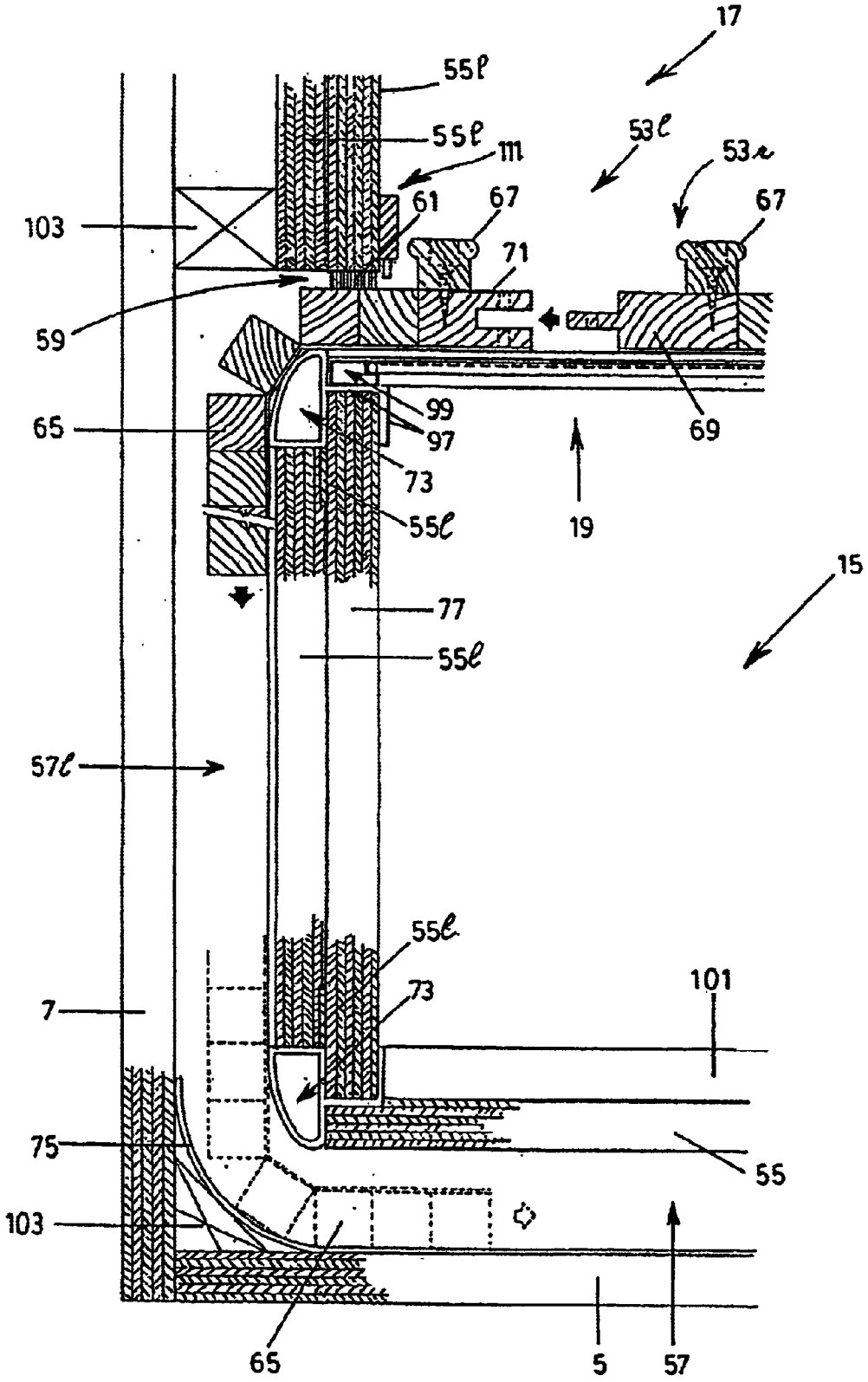
FIG. 4 is an enlarged view of the bottom section and a partial view of the first intermediate section of the window assembly shown in FIG. 2*b*.
Figure 6:
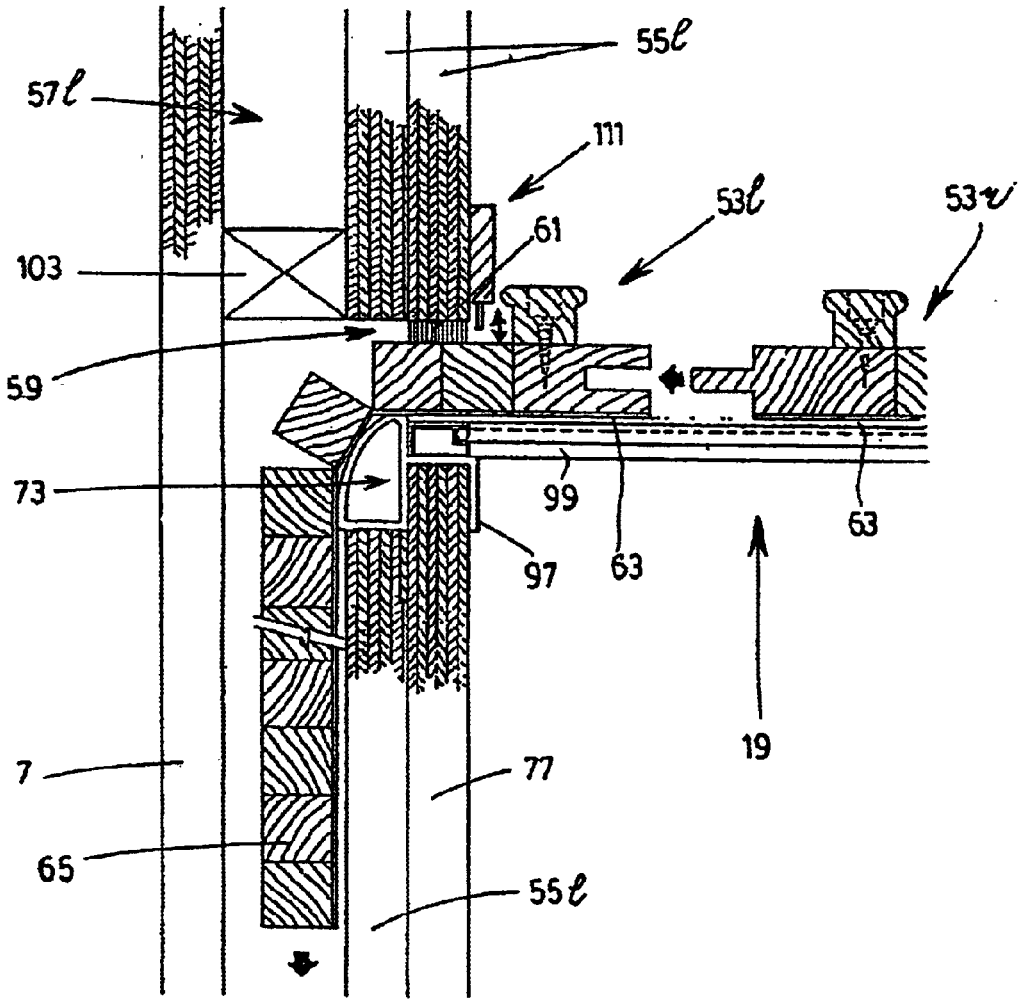
FIG. 6 is a partial view of the first and second intermediate sections of the window assembly shown in FIG. 2*b*.

Preferably, as also shown in FIGS. 4 and 6, each additional side panel 55 is provided with a rounded profiled connector 73 for facilitating operation of each shutter 53 when sliding over said rounded profiled connector 73.

Preferably, the upper and lower rounded profiled connectors 73 are made identical so as to be able to produce these rounded profiled connectors 73 with a same given die, thus reducing manufacturing steps, and these rounded profiled connectors 73 are preferably mounted onto a corresponding additional panel by suitable means, as apparent to a person skilled in the art, or by providing the rounded profiled connectors 73 with corresponding mounting flanges 97 for enabling the rounded profiled connectors 73 to be removably mountable onto corresponding panels of the window assembly 1, namely the support members 77 preferably, as better illustrated in FIGS. 4 and 6, and as will be explained hereinbelow, these rounded profiled connectors 73 with their mounting flanges 97 enabling namely to reduce assembling steps. Moreover, as will also be explained in greater detail hereinbelow, the mounting flanges 97 of the rounded profiled connectors 73 also act as supporting means for receiving a corresponding fly screen 99 of the window assembly 1, as better shown in FIGS. 4 and 6, and also explained hereinbelow. Preferably also, each empty space 57 between two neighboring panels comprises a curved bend 75 for facilitating operation of each shutter 53 when sliding into the empty space 57 and over said curved bend 75.

As also better shown in FIGS. 4 and 6, and as can be easily understood from FIGS. 3, 5 and 7, the at least one intermediate section 17 comprises at least one support member 77 mounted onto a corresponding side panel 7, 9, 55 of the frame for resting against and supporting the glass panel 33. Preferably also, the at least one support member 77 is triangular-shaped, and is suitably mounted onto the corresponding side panel 55, such as by nailing, screwing, clipping, or by using other suitable fastening means, as apparent to a person skilled in the art. As previously mentioned, the support members 77 preferably also act as supporting means for the mounting flanges 97 of the rounded profiled connectors 73, as better shown in FIGS. 4 and 6, and may take on other shapes, as apparent to a person skilled in the art.

Preferably also, and when referring to FIGS. 1, 2, 7 and 8, the window assembly 1 preferably comprises a top section 79 within the frame, and positioned above the at least one intermediate section 17, the top section 79 having a front side 11*c* extending along the front side 11 of the frame and a rear side 13*c* extending along the rear side 13 of the frame, the rear side 13*c* of the top section 79 having an opening for receiving air from the opening on the front side 11*b* of the at least one intermediate section 17 (i.e. outdoors) via a bottom side 81 of the top section 79, as can be easily understood from FIG. 7.

Preferably, as also shown, the window assembly 1 comprises additional regulating means 83 cooperating with the bottom side 81 of the top section 79 and movable with respect to said bottom side 81 for regulating the passage of air therethrough, and thus regulating an air circulation between the front of the window assembly 1 (i.e. outdoors) and the rear of the window assembly 1 (i.e. indoors).

As better shown in FIG. 7, the additional regulating means 83 preferably comprise a hinged cover 85 with corresponding hinge 107, said cover 85 being operable between a closed configuration where the cover 85 is placed over the bottom side 81 of the top section 79 so as to cover the same and thus impede air from passing therethrough, and an opened configuration where the cover 85 is drawn away from the bottom side 81 of the top section 79 so as to expose the same and allow the passage of air from the opening on the front side 11*b* of the at least one intermediate section 17 to the opening on the rear side 13*c* of the top section 79 via said bottom side 81 of the top section 79.

Preferably also, as better shown in FIGS. 2, 5, and 7, the window assembly 1 comprises actuating means 87 for actuating the additional regulating means 83 between opened and closed configurations. These actuating means 87 preferably comprise a rope 89 having a first end 91 connected within the frame to the hinged cover 85 and a second end 93 positioned outside of the frame on the rear side 13 thereof for pulling thereon so as to actuate the hinged cover 85. The window assembly may also comprise suitable guiding mechanisms 109 for guiding the rope 89 and an anchoring point (not shown) mounted onto the rear side 13 of the frame for anchoring the second end 93 of the rope 89 after having actuated the hinged cover 85.

As can be easily understood from the accompanying drawings, the top section 79 of the window assembly 1 cooperates with a lower intermediate section 17 in a very similar manner as does an intermediate section 17 of the window assembly 1 with a bottom section 15 placed below it. Indeed, the top section 79 of the present window assembly 1 is very similar to a given intermediate section 17 aside from the fact that the top section 79 does not have an upper opening (i.e. a bottom opening 19) for enabling the passage of air into a corresponding adjacent section placed above it, the top section 79 being by definition the uppermost section of the window assembly 1.

Preferably also, as better shown in FIG. 7, the front side 11*c* of the top section 79 is a closed-ended side, and the rear side 13*c* of the top section 79 is provided with a screen 95 removably mountable onto said rear side 13*c*, with suitable means, as apparent to a person skilled in the art.

Similarly to the mounting flanges 97 of the rounded profiled connectors 73, each given profiled connector 29, 31, 49 provided onto a corresponding support plate 23, 25, 27 comprises a mounting flange 97 for mounting the given profiled connector 29, 31, 49 onto said corresponding support plate 23, 25, 27. Preferably, these mounting flanges 97 are shaped and sized to cover a substantial portion of an outer face of the corresponding support plates, for ensuring namely a proper mounting of the profiled connectors 29, 31, 49 onto their corresponding support plates 23, 25, 27, but also so as to further prevent tampering thereof, particularly in the case of the front support plates 23, as previously mentioned, and thus ensure a maximal security of the window assembly 1 against theft and the like. Moreover, as better shown in FIG. 5, the mounting flanges 97 of the profiled connectors 29, 31, 49 mounted onto corresponding support plate 23, 25, 27 preferably comprises a hooking portion so as to hook a bottom rim of the given support plate 23, 25, 27, as better shown in FIG. 5. Furthermore, as can be easily understood from FIG. 5, the inside portion of this profiled connector 29 may be provided with a material different from the material of the connector 29 itself, so as to provide said connector 29 with added rigidity, and thus prevent warping of the connector 29. Alternatively, the profiled connector 29 could be made so as to not have a hollow inside portion, but rather a substantially rigid and full inner portion, as apparent to a person skilled in the art.

Preferably, as better shown in FIGS. 3 and 5, the bottom side 19 of the at least one intermediate section 17 is provided with a retractable fly screen 99. As previously mentioned, a given retractable fly screen 99 is preferably supported by the mounting flanges 97 of the rounded profiled connector 73 so as to be slidably moveable therealong, as can be easily understood from the above-mentioned figures, the fly screen 99 being operable between a screening configuration where it is positioned over the bottom side 19 of the at least one intermediate section 17 so as to carry out its normal screening functions, and a retracted configuration where it is drawn away outwardly from the front side of the frame simply by sliding the fly screen 99 along the corresponding support flanges of the rounded profiled connectors 73, the fly screen 99 preferably comprising a rim provided with suitable abutment and locking means for ensuring that the fly screen 99 stops at a given location when retracted outwardly, and removably engaging a corresponding component for maintaining said fly screen 99 in a given retracted configuration, said removably engaging blocking means preferably consisting of a pin removably insertable into a corresponding bore provided along the rim of the fly screen 99.

Preferably also, as better shown in FIG. 3, the bottom section 15 comprises an evacuating plane 101 being slanted so as to evacuate precipitation falling onto the plane 101 out of the frame via the front side 11 thereof.

Preferably, as shown in the accompanying drawings, the window assembly 1 comprises blocks 103 connected between corresponding side panels 7, 9, 55. These blocks 103 do not only provide a reinforcement for the frame, but are preferably also positioned along neighboring side panels so as to act as stoppers for the travel of the corresponding shutters 53 of a given intermediate section 17, when in an opened configuration, as can be easily understood by a person skilled in the art.

Preferably, as better shown in FIGS. 4 and 6, the window assembly 1 comprises locking means 111 for locking the regulating means 21 (i.e shutters 53) in an intermediate configuration.

Preferably, as better shown in FIGS. 5 and 7, the top peripheral edges 37 of the glass panels 33 may be provided with corresponding hooks or connectors 41 for receiving additional insulating layers (not shown) which could be simply hooked onto these hooks 41 for providing additional insulation to the glass panels 33, so as to preserve the heat inside during cold temperatures, and for preserving cool air inside during warm weather. These additional insulating coverings may be hooked onto the hooks 41 via the bottom side 19 of a corresponding section 17 when the regulating means 21 are in an opened configuration.

As can be easily understood from the above-described, the preferred embodiment of window assembly 1 illustrated in the accompanying drawings is preferably intended for minimizing components and assembling steps, while providing a suitable manner for easily, quickly and safely servicing and/or replacing a given component of the window assembly 1.

Moreover, according to another aspect of the present invention, there is also provided an establishment, such as a room, a house, a building, and/or other structure provided with a window assembly 1 such as the ones described and illustrated herein, as exemplified in the accompanying figures.

As may now be appreciated, the present invention is a substantial improvement over other related window assemblies known in the prior art in that, by virtue of its design and components, the window assembly 1 according to the present invention overcomes several of the prior art problems.

Preferably also, the various components of the window assembly 1 according to the present invention are made of suitable materials for properly sustaining the different loads and strains to which the window assembly 1 may be subjected to, as well as for withstanding corresponding weather conditions, moisture conditions, and the like, as apparent to a person skilled in the art. For example, most of the components of the window assembly 1, particularly those of the bottom section 15 which is more likely subjected to precipitations, etc., are preferably made of a suitable moisture resistant material, such as cellular PVC, and/or the like, for instance. The different profiled connectors 29, 31, 39, 41, 49 of the window assembly 1 are also preferably made of suitable polymer materials, such as PVC, and the like, which provide suitable insulation capabilities, and offer convenient flexible capabilities, and are made conveniently by suitable manufacturing processes, such as extrusion, for example, as can be easily understood. In contrast, the support plates 23, 25, 27 of the window assembly 1 are preferably made of more rigid materials, such as metallic materials, and the like, because they are used for supporting the glass panels 33, etc., as can be easily understood by a person skilled in the art. The corresponding top, bottom, left and right side panels 3, 5, 7, 9 of the window assembly 1 are typically made of wood, or other suitable materials, as is common in the art. It is worth mentioning that all the nature of materials used for the different components of the window assembly 1 may be changed depending on the particular applications for which the window assembly 1 is intended for, and the different evolution in materials which could take place, as apparent to a person skilled in the art.

As may now be appreciated, the present invention is a substantial improvement over the windows of the prior art in that, by virtue of its design and components, as briefly explained herein, the window assembly 1 according to the present invention a) does not define a direct passage for air circulation between the outside environment and the inside environment, thereby preventing the inside environment to be directly subject to adverse weather conditions such as violent winds, precipitations (rain, snow, and the like) which could be present in the outside environment; b) adjustably allows an air circulation between an outside environment of the window assembly 1 and an inside environment of the window assembly 1 via corresponding regulating means 21 provided along a bottom side 19 of at least one intermediate section 17, that is, without having to displace a glass panel 33; c) does not require the use of hardware, such as four-bar mechanisms, hinges, rotating levers, and the like, the only moveable components of the present invention, namely the regulating means 21, being slidably moveable along corresponding support flanges 51; d) has components which can be easily mountable and demountable, so as to be advantageously manufactured, assembled, installed, serviced, and/or replaced, and this being able to be carried out in a very quick, easy, and economic manner, from the inside of a given room, that is from the inside environment of the window assembly 1, without having to be located outside of the window assembly 1, as is the case with most conventional window assemblies; e) the fly screen 99 of the present window assembly 1 carries out its functions without hindering in any way the field of view onto the outside environment from the inside environment; f) the glass panels 33 are able to be provided with corresponding connectors 41 so as to receive corresponding additional insulation coverings so as to provide the glass panels 33 with additional insulation means so as to reduce heat losses which may occur therethrough when there exists substantial temperature gradients between the inside environment and the outside environment; g) provides securely features for preventing tampering of the window assembly 1; and h) provides an economical window assembly 1 devised to have components and glass panels 33 which can be easily assembled, installed, serviced, and/or replaced, and which enables different window configurations due to the modular aspect of the assembly 1.

Of course, numerous modifications could be made to the above-described embodiments without departing from the scope of the invention as defined in the appended claims.

What is claimed is:

1. A window assembly (1) for adjustably allowing an air circulation between an outside environment of the window assembly and an inside environment of the window assembly, the window assembly (1) comprising a rectangular frame having opposite top and bottom panels (3,5), and opposite left and right side panels (7,9), the frame having a front side (11) for cooperating with the outside environment, and a rear side (13) for cooperating with the inside environment, the window assembly (1) comprising:

a bottom section (15) within the frame, the bottom section (15) having a front side **(11*a*)extending along the front side (11) of the frame and a rear side (13*a*) extending along the rear side (13) of the frame, the front side (11*a*) of the bottom section (15)** having an opening for receiving air from the outside environment;

at least one intermediate section (17) within the frame, and positioned above the bottom section (15), the at least one intermediate section (17) having a front side **(11*b*) extending along the front side (11) of the frame and a rear side (13*b*) extending along the rear side (13) of the frame, the rear side (13*b*) of the at least one intermediate section (17) having an opening for receiving air from the opening on the front side (11*a*) of the bottom section (15) via a bottom side (19) of the at least one intermediate section (17)**;

regulating means (21) cooperating with the bottom side (19) of the at least one intermediate section (17) and movable with respect to said bottom side (19) for regulating the passage of air therethrough;

a first front support plate (23) mounted onto the front side (11) of the frame, the first front support plate (23) having ends connected respectively to the left and right side panels (7, 9) of the frame, and a first rear support plate (25) mounted onto the rear side (13) of the frame, the first rear support plate (25) having ends connected respectively to the left and right side panels (7, 9) of the frame, said support plates (23, 25) delimiting the bottom section (15) from the at least one intermediate section (17) of the frame; and a second rear support plate (27) mounted onto the rear side (13) of the frame, above the first rear support plate (25), the second rear support plate (27) also having ends connected respectively to the left and right side panels (7, 9) of the frame, the first front support plate (23) and the second rear support plate (27) being provided with profiled connectors (29, 31), and wherein the at least one intermediate section (17) comprises a glass panel (33) extending in a slanted manner within the at least one intermediate section (17) of the frame from the front side (11) to the rear side (13) thereof, the glass panel (33) having a bottom peripheral edge (35) operatively connected to the profiled connector (29) provided on the first front support plate (23) and a top peripheral edge (37) operatively connected to the profiled connector (33) provided on the second rear support plate (27).

2. A window assembly (1) according to claim 1, wherein the bottom and top peripheral edges (35, 37) of the glass panel (33) are provided with profiled connectors (39, 41) having portions being complementary in shape to portions of the profiled connectors (29, 31) provided on the support plates (23, 27).

3. A window assembly (1) according to claim 2, wherein the profiled connector (39) provided on the bottom peripheral edge (35) of the glass panel (3) comprises an evacuating flange (45) extending outwardly from the front side (11) of the frame, beyond the profiled connector (29) provided on the first front support plate (23).

4. A window assembly (1) according to claim 1, wherein the first rear support plate (25) is also provided with a profiled connector (49), the profiled connectors (29, 49) provided on the first front support plate (23) and the first rear support plate (25) each having a support flange (51) for supporting the regulating means (21).

5. A window assembly (1) according to claim 4, wherein the regulating means (21) comprise at least one shutter (53) slidably movable along the support flanges (51) of the connectors (29, 49) provided on the first front support plate (23) and the first rear support plate (25), the at least one shutter (53) being operable between a closed configuration where the at least one shutter (53) covers the bottom side (19) of the least one intermediate section (17) and thus impedes air from passing therethrough, and an opened configuration where the at least one shutter (53) is urged away from the bottom side (19) so as to allow the passage of air from the opening on the front side **(11*a*) of the bottom section (15) to the opening on the rear side (13*b*) of the at least one intermediate section (17) via said bottom side (19) of the at least one intermediate section (17)**.

6. A window assembly (1) according to claim 5, wherein the frame comprises an additional side panel (55) positioned adjacent to a corresponding side panel (7, 9) for defining thereinbetween an empty space (57), said empty space (57) being shaped and sized for receiving a retracted portion of the at least one shutter (53) when operated in the opened configuration, through a corresponding slot (59) provided on the additional side panel 55).

7. A window assembly (1) according to claim 5, wherein each shutter (53) comprises a substantially rectangular malleable curtain (63), said curtain (63) being devised to slide along the support flanges (51) of the connectors (29, 49) provided on the first front support plate (23) and the first rear support plate (25).

8. A window assembly (1) according to claim 6, wherein each additional side panel (55) is provided with a rounded profiled connector (73) for facilitating operation of each shutter (53) when sliding over said rounded profiled connector (73).

9. A window assembly (1) according to claim 1, wherein the at least one intermediate section (17) comprises at least one support member (77) mounted onto a corresponding side panel (7, 9, 55) of the frame for resting against and supporting the glass panel (33).

10. A window assembly (1) according to claim 1, wherein the window assembly (1) comprises:

a top section (79) within the frame, and positioned above the at least one intermediate section (17), the top section (79) having a front side **(11*c*) extending along the front side (11) of the frame and a rear side (13*c*) extending along the rear side (13) of the frame, the rear side (13*c*) of the top section (79) having an opening for receiving air from the opening on the front side (11*b*) of the at least one intermediate section (17) via a bottom side (81) of the top section (79); and additional regulating means (83) cooperating with the bottom side (81) of the top section (79) and movable with respect to said bottom side (81)** for regulating the passage of air therethrough.

11. A window assembly (1) according to claim 10, wherein the additional regulating means (83) comprise a hinged cover (85) operable between a closed configuration where the cover (85) is placed over the bottom side (81) of the top section (79) so as to cover the same and thus impede air from passing therethrough, and an opened configuration where the cover (85) is drawn away from the bottom side (81) of the top section (79) so as to expose the same and allow the passage of air from the opening on the front side (11*b*) of the at least one intermediate section (17) to the opening on the rear side (13*c*) of the top section (79) via said bottom side (81) of the top section (79).

12. A window assembly (1) according to claim 11, where the window assembly (1) comprises actuating means (87) for actuating the additional regulating means (83) between opened and closed configurations.

13. A window assembly (1) according to claim 1, wherein each given profiled connector (29, 31, 49) provided onto a corresponding support plate (23, 26, 27) comprises a mounting flange (97) for mounting the given profiled connector (29, 31, 49) onto said corresponding support plate (23, 25, 27).

14. A window assembly (1) according to claim 13, wherein the mounting flange (96) is shaped and sized to cover a substantial portion of an outer face of the corresponding support plate.

15. A window assembly (1) according to claim 1, wherein the bottom side (19) of the at least one intermediate section (17) is provided with a retractable fly screen (99).

16. A window assembly (1) according to claim 1, wherein the bottom section (15) comprises an evacuating plane (101) being slanted so as to evacuate precipitation falling onto the plane (101) out of the frame via the front side (11) thereof.

17. A window assembly (1) according to claim 1, wherein the window assembly (1) comprises locking means for locking the regulating means (21) in an intermediate configuration.

18. A building having a room provided with a window assembly (1) according to claim 1.

* * * * *